US005695137A

United States Patent [19]

Prospero et al.

[11] Patent Number: 5,695,137

[45] Date of Patent: Dec. 9, 1997

[54] PALLET ASSEMBLY FOR DETACHABLY MOUNTING BOBBINS

[75] Inventors: Richard M. Prospero, Princeton; Erik Lunde, Morganville; Harry Swanson, Bloomfield; Lee Adams, Flemington, all of N.J.

[73] Assignee: Johnson & Johnson Consumer Products, Inc., Skillman, N.J.

[21] Appl. No.: 690,880

[22] Filed: Jul. 26, 1996

Related U.S. Application Data

[63] Continuation of Ser. No. 380,430, Jan. 31, 1995, abandoned.

[51] Int. Cl.[6] ..... B65H 54/02; B65H 75/24; B65H 75/28; B65G 29/00

[52] U.S. Cl. ..... 242/35.5 A; 198/803.12; 198/465.2; 242/571.4; 242/129; 242/125.2; 242/172

[58] Field of Search ..... 242/35.5 A, 35.5 R, 242/18 R, 129, 571.4, 571.5, 125, 125.2, 172, 572, 140, 141; 198/803.01, 803.2, 803.12, 465.1, 465.2, 465.3; 57/281

[56] References Cited

U.S. PATENT DOCUMENTS

| | | | |
|---|---|---|---|
| 164,740 | 6/1875 | Houghton . | |
| 216,666 | 6/1879 | Fay . | |
| 307,890 | 11/1884 | Wilkinson . | |
| 395,169 | 12/1888 | Outt . | |
| 724,975 | 4/1903 | Wardwell . | |
| 1,730,431 | 10/1929 | Keefer . | |
| 2,806,661 | 9/1957 | Markoff-Moghadam . | |
| 3,314,032 | 4/1967 | Van Erden . | |
| 3,730,340 | 5/1973 | Neubert . | |
| 4,147,019 | 4/1979 | Novak . | |
| 4,482,051 | 11/1984 | Cantey, Jr. . | |
| 4,688,838 | 8/1987 | Skillman . | |
| 4,713,883 | 12/1987 | Santandrea et al. | 198/803.01 X |
| 4,770,354 | 9/1988 | Sanno | 242/35.5 R |
| 4,781,334 | 11/1988 | Derichs | 242/35.5 A |
| 4,824,042 | 4/1989 | Whitaker et al. | 242/141 X |
| 4,832,282 | 5/1989 | Koike | 242/140 X |
| 4,944,146 | 7/1990 | Scaglia | 242/35.5 A X |
| 5,000,231 | 3/1991 | Takehana et al. | 242/35.5 A X |
| 5,065,499 | 11/1991 | Luciano et al. | 198/803.01 X |
| 5,085,378 | 2/1992 | Guttler . | |
| 5,113,645 | 5/1992 | Hauers et al. | 57/281 X |
| 5,197,272 | 3/1993 | Frey . | |
| 5,297,671 | 3/1994 | Ruth . | |

*Primary Examiner*—Michael Mansen

[57] ABSTRACT

A method and apparatus for holding a wound bobbin core and a tail end of a thread wound on the bobbin core. A vertical bobbin post is rigidly secured to the upper surface of a pallet. The bobbin core is detachably secured to the vertical bobbin post. A tail gripping post and a tail gripping wire are provided for grasping the tail end of the thread wound on the bobbin core when the bobbin core is secured on the vertical bobbin post. The tail gripping post is also rigidly secured to the upper surface of the pallet.

14 Claims, 5 Drawing Sheets

PALLET ASSEMBLY FOR DETACHABLY MOUNTING BOBBINS

This is a continuation of application Ser. No. 08/380,430, now abandoned filed Jan. 31, 1995, which is hereby incorporated by reference.

FIELD OF THE INVENTION

The present invention relates generally to systems for winding threads or yarns onto winding cores. More particularly, the present invention relates to automated systems for storing and transporting threads or yarns contained on winding cores. Still more particularly, the present invention relates to automated systems for assembling and manufacturing dental floss products containing bobbin cores wound with dental floss.

BACKGROUND OF THE INVENTION

Tooth decay and dental disease can be caused by bacterial action resulting from the formation of plaque about the teeth and/or the entrapment of food particles between the teeth and interstices therebetween. The removal of plaque and entrapped food particles reduces the incidence of caries, gingivitis, and mouth odors as well as generally improving oral hygiene. Conventional brushing has been found to be inadequate for removing all entrapped food particles and plaque. To supplement brushing, dental flosses and tapes have been recommended. The term "dental floss", as used herein, is defined to include both dental flosses, dental tapes and any similar article.

Dental floss is typically distributed in dispensers that have circular bobbins rotatably mounted therein. Each bobbin is formed of a core that has been wound with dental floss. The tail end of floss from the bobbin is typically threaded first through an eyelet at the top of the dispenser and then through a cut bar that is also positioned at the top of the dispenser. In order to draw a length of floss from the dispenser, a user grasps the tail end of the floss, pulls until the desired length of floss has been drawn from the dispenser, and then cuts the drawn length using the cut bar. As the user pulls the floss from the dispenser, the bobbin in the dispenser rotates, thereby allowing the floss on the bobbin to unwind.

During the manufacturing of dental floss products, automated winding machines are used to wind floss onto empty bobbin cores. These winding machines often function at a high speed and may wind many yards of dental floss each minute. After the dental floss is wound onto bobbin cores, the wound cores must then be inserted and threaded into dispensers. During the insertion and threading of a wound bobbin core into a dispenser, the tail end of floss from the bobbin must be threaded through a small eyelet at the top of the dispenser and also through a cut bar that is positioned at the top of the dispenser. In order to accomplish this threading operation, the tail of the floss must be firmly grasped and manipulated by either a human operator or a mechanical grasping device.

During the manufacturing of dental floss products, the operation of winding floss onto empty bobbin cores and the operation of inserting and threading wound bobbin cores into dispensers may take place at a different times and/or locations. It is therefore desirable to have a device for temporally storing and/or transporting wound bobbins as such bobbins are produced by the bobbin winding machines. In order to facilitate the operation of inserting and threading the wound bobbins into dispensers, the storage device must make both the wound bobbin itself and the tail end of the thread on the bobbin readily accessible to the operator or device performing the inserting and threading operation.

It is therefore an object of the present invention to provide an efficient and cost-effective system for temporally storing and transporting bobbins from a bobbin winding machine to a station for inserting and threading the wound bobbin core into a dispenser.

It is a further object of the present invention to provide a system for storing and transporting wound bobbins so that both the bobbin itself and the tail end of the thread on the bobbin are readily accessible to an operator or device attempting to remove the bobbin and tail.

These and still other objects of the invention will become apparent upon study of the accompanying drawings and description of the invention.

SUMMARY OF THE INVENTION

The present invention is directed to a method and apparatus for holding a wound bobbin core and a tail end of a thread wound on the bobbin core. A vertical bobbin post is rigidly secured to the upper surface of a pallet. The vertical bobbin post includes means for detachably securing the bobbin core to the vertical bobbin post. Tail gripping means are provided for grasping the tail end of the thread wound on the bobbin core when the bobbin core is secured on the vertical bobbin post. The tail gripping means is also rigidly secured to the upper surface of the pallet.

DETAILED DESCRIPTION OF THE PREFERRED EMBODIMENT

Figure 1:
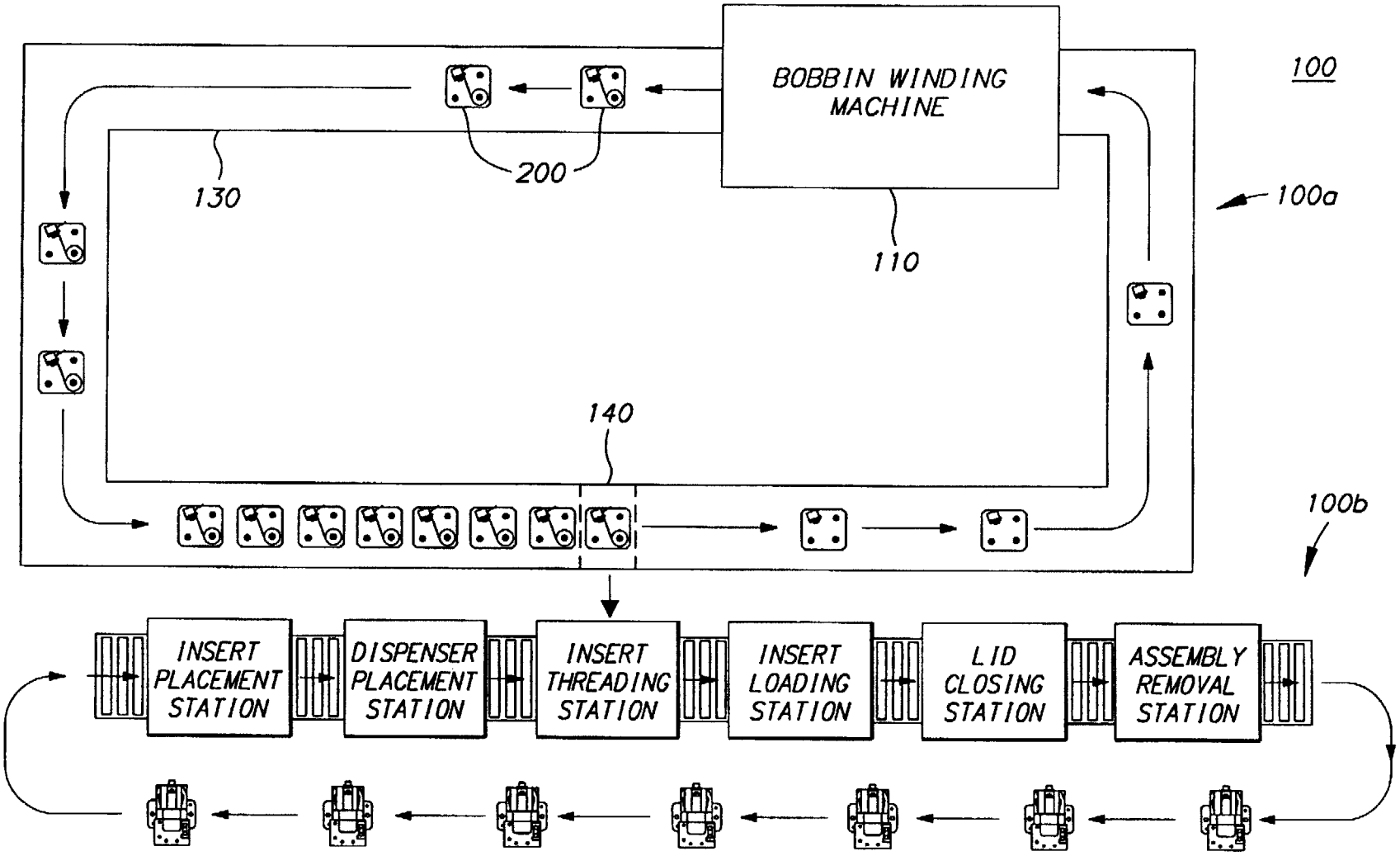
FIG. 1 is a block diagram of an automated system for manufacturing and assembling dental floss products in accordance with a preferred embodiment of the present invention.

Referring now to FIG. 1, there is shown a block diagram of an automated system 100 for manufacturing and assembly dental floss products in accordance with a preferred embodiment of the present invention. Automated system 100 is formed of a wound bobbin delivery loop 100*a*, and a dental floss product assembly loop 100*b*. In wound bobbin delivery loop 100*a*, dental floss is wound onto empty bobbin cores in bobbin winding machine 110. As wound bobbin cores are produced by bobbin winding machine 110, each wound bobbin core is placed on a pallet assembly 200. The wound bobbin cores are then carried on pallet assemblies 200 along track 130 in a circulating direction. As the pallet assemblies 200 reach bobbin removal station 140, the wound bobbins on pallet assemblies 200 are transferred into an insert threading station in dental floss product assembly loop 100*b* where the wound bobbins are used in assembling dental floss products. The details of the operation of dental floss product assembly loop 100*b* are disclosed in U.S. patent application Ser. No. 08/381,512, entitled "Fixture for Assembling Dental Floss Dispenser Products," filed simultaneously herewith, the contents of which are hereby incorporated herein in their entirety by reference. After the wound bobbins are removed from pallet assemblies 200 at removal station 140, the empty pallet assemblies 120 are recycled back to bobbin winding station 110 for further use.

Figure 2:
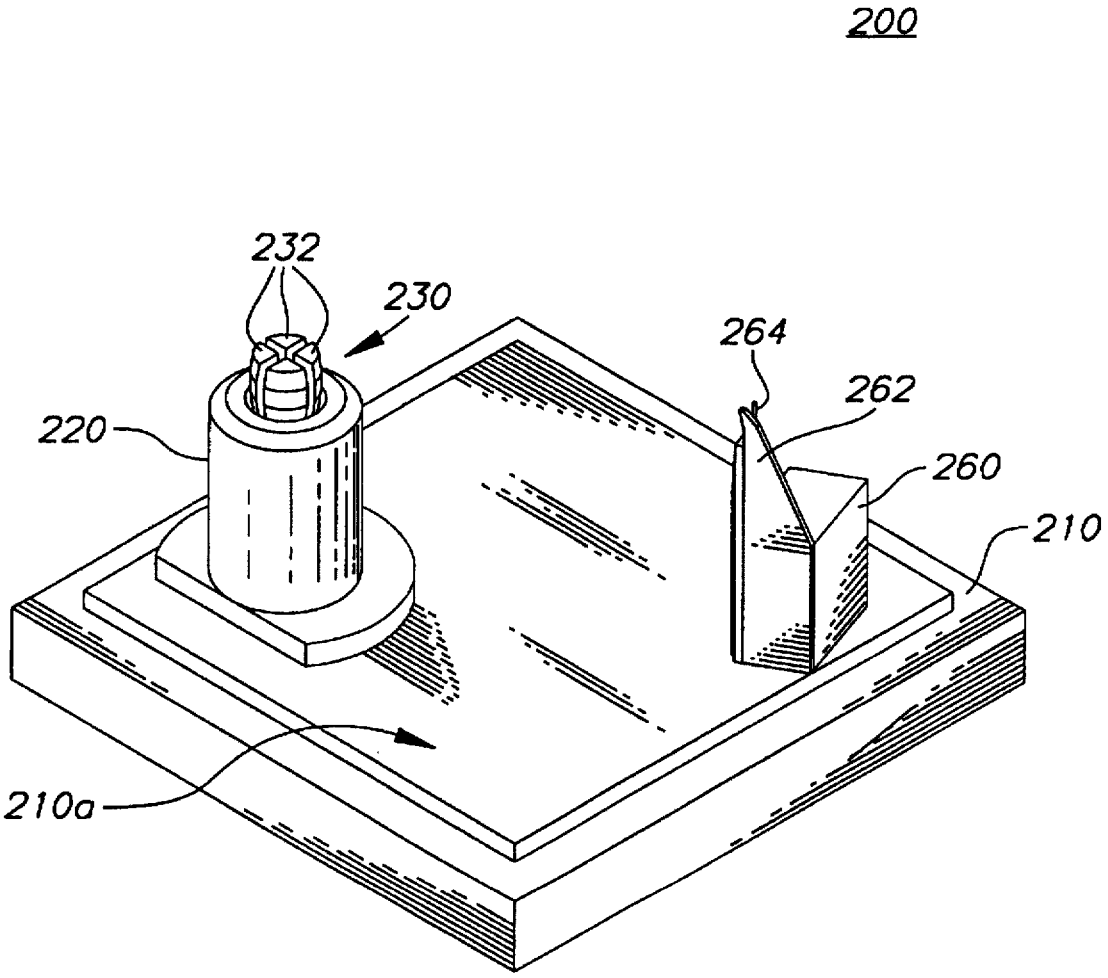
FIG. 2 is a perspective view of a pallet assembly for detachably mounting a wound bobbin core in accordance with a preferred embodiment of the present invention.
Figure 3:
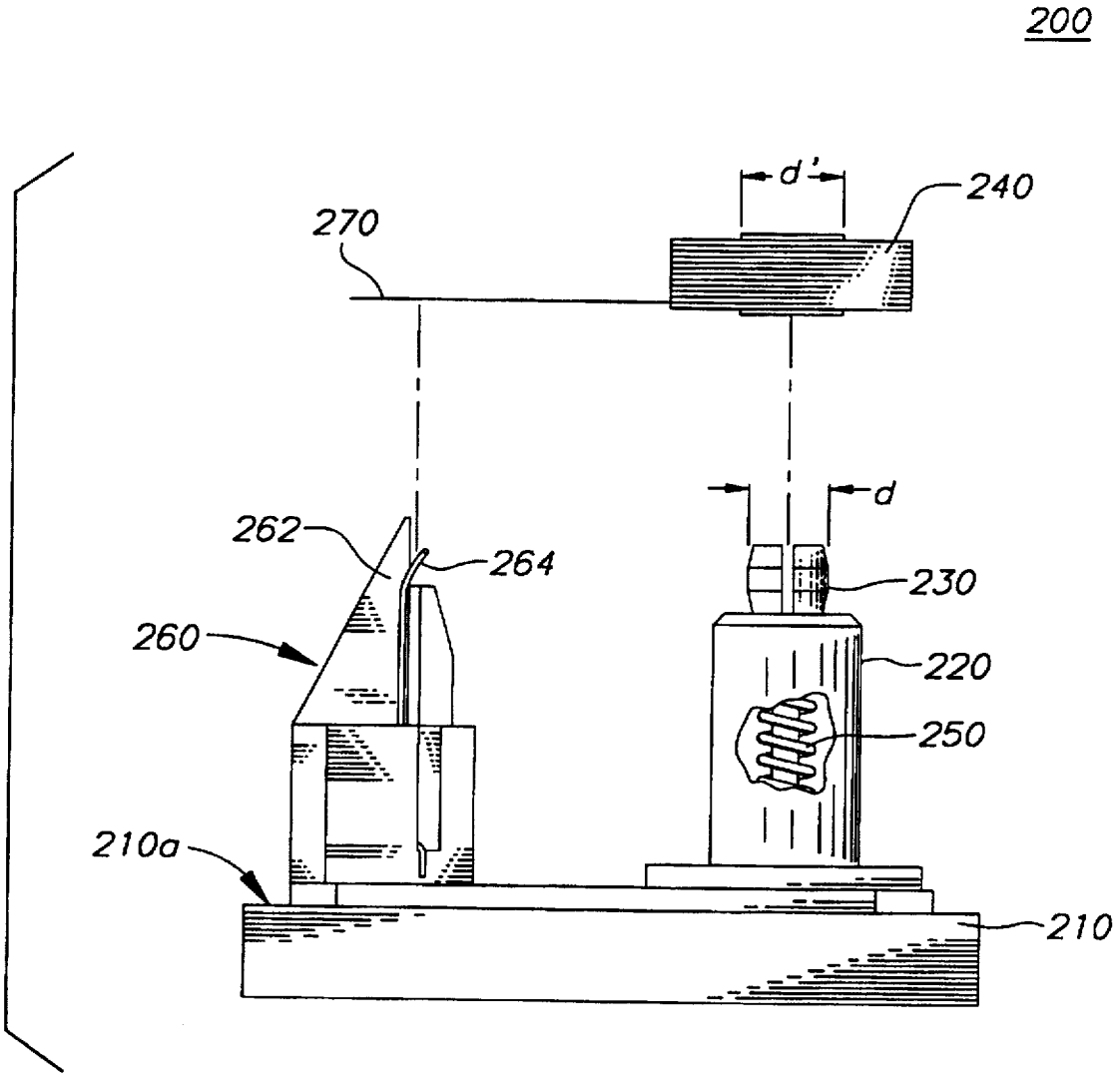
FIG. 3 is a cut-away view of the pallet assembly for detachably mounting a wound bobbin core shown in FIG. 2.
Figure 4:
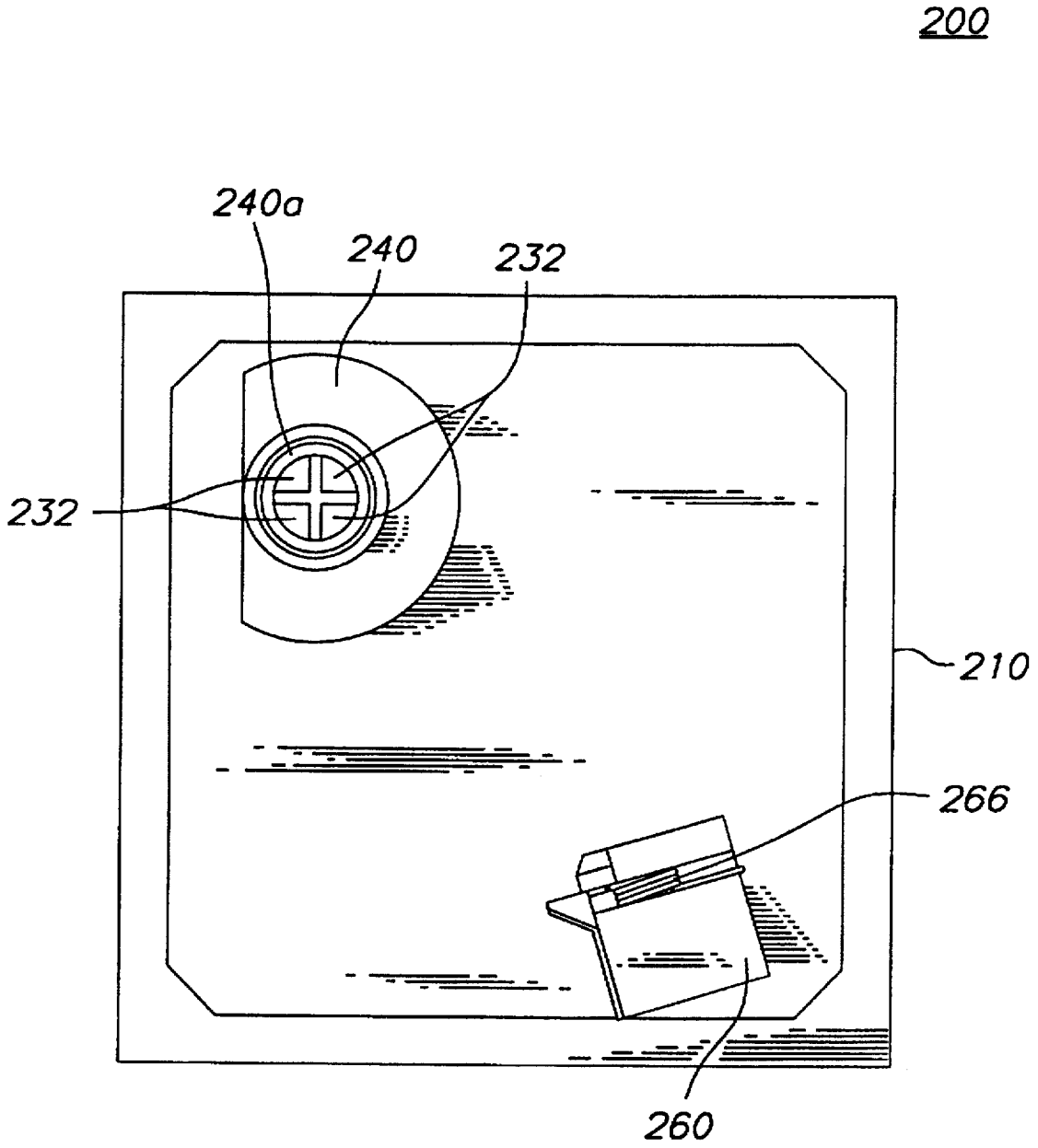
FIG. 4 a top view of a pallet assembly for detachably mounting a wound bobbin core in accordance with a preferred embodiment of the present invention.

Referring now to FIGS. 2, 3, and 4, there are shown perspective, cut-away and top views, respectively, of a pallet assembly 200 for detachably mounting a wound bobbin core in accordance with a preferred embodiment of the present invention. Pallet assembly 200 is formed at its base of a pallet 210 for carrying assembly 200 along track 130. A vertical bobbin post 220 is rigidly secured to pallet 210 in a direction perpendicular to the upper surface 210*a* of pallet 210. Vertical bobbin post 220 includes a bobbin core holder 230 for detachably securing wound bobbin 240 to vertical bobbin post 220. As explained more fully below, in the preferred embodiment, bobbin core holder 230 preferably generates an interference force fit between the exterior surface of the bobbin core holder and the interior surface 240*a* of wound bobbin 240. A vertically depressable spring 250 is positioned within the interior of vertical bobbin post 220. One end of the vertically depressable spring 250 is secured to the bobbin core holder 230. A tail gripping means 260 is rigidly secured to pallet 210 in a direction perpendicular to the upper surface 210*a* of pallet 210. Tail gripping means 260 functions to grasp (or pinch) the tail end 270 of the thread on wound bobbin 240.

In the preferred embodiment, the diameter d of bobbin core holder 230 is slightly greater than the diameter d' of the circular space defined by the interior surface 240*a* of wound bobbin core 240. Bobbin core holder 230 is formed of fingers 232 which bend in an inward direction towards each other when an external force is applied. Wound bobbin core 240 is mounted on the bobbin core holder 230 by aligning the interior surface 240*a* with the bobbin core holder 230, and applying a downward force on the bobbin core 240 until it is pushed on the bobbin core holder 230. As this downward mounting force is applied, fingers 232 bend inwardly until the diameter d of bobbin core holder 230 become less than the diameter d' of the bobbin core 240, thereby allowing the bobbin core 240 to fit onto the bobbin core holder 230. Once the bobbin core 240 has been mounted in this fashion, the fingers 232 tend to exert an outward pressure against interior surface 240*a*, and thus create an interference fit between interior surface 240*a* and the bobbin core holder 230. In the preferred embodiment, the downward force necessary to mount the bobbin core 240 on the bobbin core holder 230 is less than the downward force required to depress vertically depressable spring 250.

At the same time that wound bobbin core 240 is detachably mounted on bobbin core holder 230 as described above, the tail end 270 of the thread is also preferably detachably mounted on the tail gripping means 260. Tail gripping means 260 is preferably comprised of a vertical tail gripping post 262, a tail gripping wire 264, and a tail gripping spring 266. Tail gripping spring 266 has its first end coupled to tail gripping post 262 and its second end coupled to tail gripping wire 264 so as to force tail gripping wire 264 into contact with tail gripping post 262. This force generated by tail gripping spring 266 is used to detachably mount tail end 270 in between tail gripping post 262 and tail gripping wire 264 when tail end 270 is inserted between post 262 and wire 264.

Figure 5:
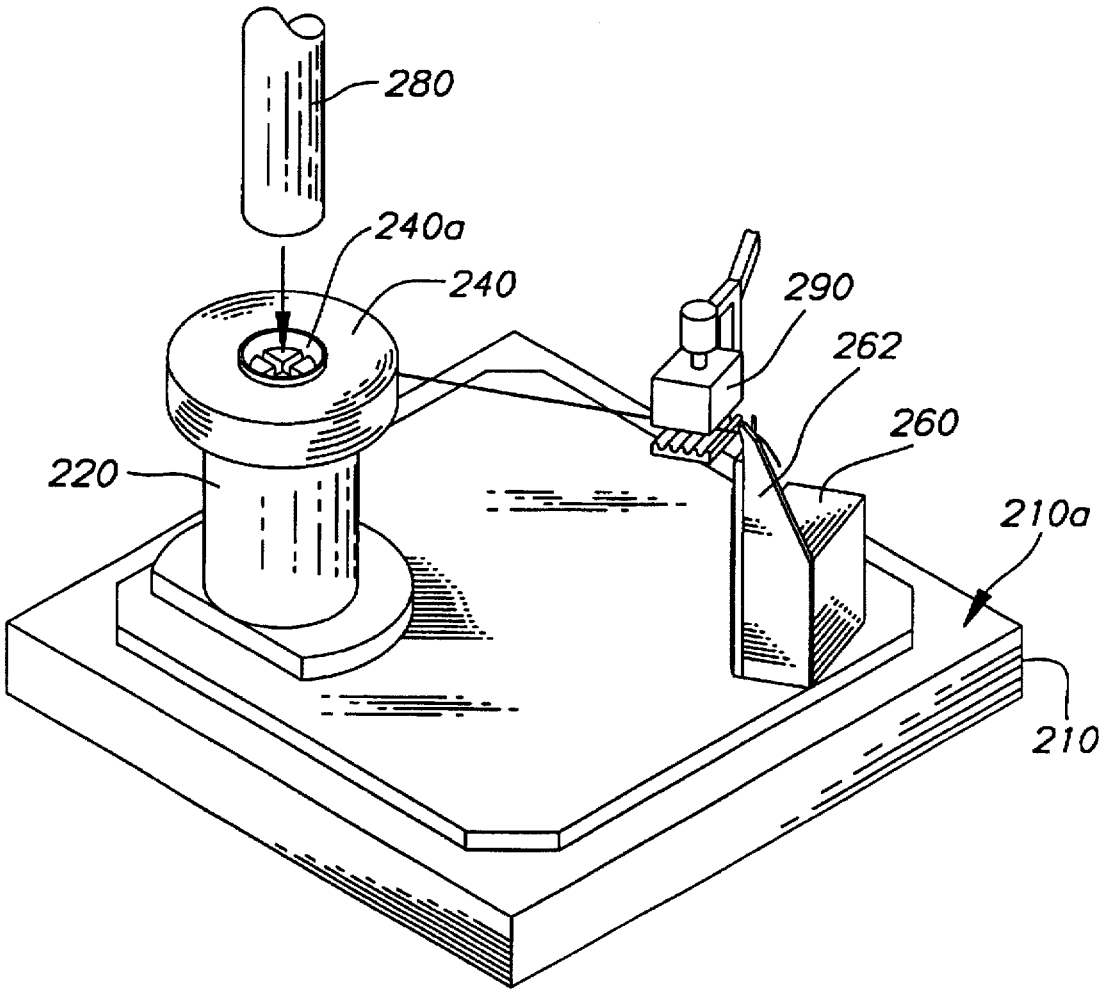
FIG. 5 is a further perspective view of a pallet assembly for detachably mounting a wound bobbin core in accordance with a preferred embodiment of the present invention.

As shown in FIG. 1, after a wound bobbin core 240 and tail end 270 have been mounted on a pallet assembly 200, the pallet assembly 200 is carried by track 130 to bobbin removal station 140 where wound bobbin 240 is removed from pallet assembly 200 and then transferred into dental floss product assembly loop 100*b*. In the preferred embodiment shown in FIG. 5, wound bobbin 240 is removed from the vertical bobbin post 220 by applying a downward force to the top of bobbin holder 230. In particular, a vertical plunger 280 having a diameter that is smaller than that of the circular space defined by the interior surface 240*a* is used to apply a downward force to the top of bobbin holder 230. This downward force is of sufficient magnitude to cause vertically depressable spring 250 to compress. As vertically depressable spring is compressed by plunger 280, the bobbin core holder 230 is forced downward until the interference force fit between bobbin core holder 230 and interior surface 240*a* is broken. As this interference force fit is broken, the wound bobbin core is freed from vertical bobbin post 220 and may thereafter be transported to the insert loading station for assembly into a complete dental floss product.

At the same time that wound bobbin core 240 is removed from bobbin core holder 230 as described above, the tail end 270 of the thread is also preferably removed from the tail gripping means 260. Tail end 270 is preferably removed from the tail gripping means 260 by grasping the thread at a point adjacent to the tail gripping post 262 and then pulling the thread in an upward direction. In the preferred embodiment, a special automated gripping assembly 290 is used to grasp tail end 270 during its removal from tail gripping means 260. Gripping assembly 290 is described in greater detail in U.S. patent application Ser. No. 08/380,429 entitled "Sinusoidal Anvil for Gripping Waxed Threads," filed simultaneously herewith, the contents of which are hereby incorporated in their entirety by reference. It will be understood by those skilled in the art that other devices, or even human operators, may be used to effect the removal of tail end 270 from tail gripping means 260.

The present invention may be embodied in other specific forms without departing from the spirit or essential attributes of the invention. Accordingly, reference should be made to the appended claims, rather than the foregoing specification, as indicating the scope of the invention.

What is claimed is:

1. An apparatus for holding a wound bobbin core and a tail end of a thread wound on said bobbin core, said wound bobbin core having a circular outer surface formed from said thread, comprising:

(A) a pallet having an upper surface;

(B) a vertical bobbin post rigidly secured to said upper surface of said pallet, said vertical bobbin post including means for detachably securing said bobbin core to said vertical bobbin post; and (C) tail gripping means, rigidly secured to said upper surface of said pallet, for grasping said tail end when said bobbin core is secured on said vertical bobbin post, said tail end grasped by said tail gripping means being positioned outside of said circular outer surface of said wound bobbin core and being connected to said wound bobbin core by a length of said thread, said length of said thread extending from said circular outer surface to said tail end.

2. The apparatus of claim 1, said vertical bobbin post including a bobbin core holder at one end of said vertical bobbin post, said bobbin core holder being sized to create an interference force fit between said bobbin core holder and an interior surface of said bobbin core when said interior surface of said bobbin core is brought into contact with said bobbin core holder.

3. The apparatus of claim 2, wherein said means for detachably securing said bobbin core to said vertical bobbin post further comprises a vertically depressable spring positioned within said vertical bobbin post, said vertically depressable spring having one end secured to said bobbin core holder.

4. The apparatus of claim 3, wherein a first downward vertical force must be applied to said bobbin core to secure said interior surface of said bobbin core against said bobbin core holder by said interference fit, and a second downward vertical force must be applied to depress said vertically depressable spring, wherein said first downward vertical force is less than said second downward vertical force.

5. The apparatus of claim 1, wherein said tail gripping means comprises a vertical tail gripping post, a tail gripping wire, and a tail gripping spring, coupled to said vertical tail gripping post and said tail gripping wire, for gripping said tail end of said thread wound on said bobbin core by pinching said tail end between said vertical tail gripping post and said tail gripping wire.

6. A method for storing and retrieving a wound bobbin core and a tail end of a thread wound on said bobbin core, said wound bobbin core having a circular outer surface formed from said thread, comprising the steps of:

(A) detachably mounting said wound bobbin core on a vertical bobbin post, said vertical bobbin post being rigidly secured to an upper surface of a pallet;

(B) detachably mounting said tail end of said thread wound on said bobbin on a tail gripping means, said tail end being positioned outside of said circular outer surface of said wound bobbin core and being connected to said wound bobbin core by a length of said thread, said length of said thread extending from said circular outer surface to said tail end, said tail gripping means being rigidly secured to said upper surface of said pallet; and (C) removing said wound bobbin core from said vertical bobbin post and said tail end from said tail gripping means.

7. The method of claim 6, wherein said wound bobbin core is detachably mounted on said vertical bobbin post in step (A) by creating an interference force fit between a bobbin core holder at one end of said vertical bobbin post and an interior surface of said bobbin core.

8. The method of claim 7, wherein said wound bobbin core is detachably mounted on said vertical bobbin post in step (A) by applying a first downward vertical force to said bobbin core until said interior surface of said bobbin core is brought into contact with said bobbin core holder.

9. The method of claim 8, wherein a vertically depressable spring positioned within said vertical bobbin post has one end secured to said bobbin core holder, said first downward force applied in step (A) being less than a second downward force required to depress said vertically depressable spring.

10. The method of claim 9, wherein said wound bobbin core is removed from said vertical bobbin post in step (C) by depressing said vertically depressable spring.

11. The method of claim 10, wherein step (C) comprises simultaneously removing said wound bobbin from said vertical bobbin post and said tail end from said tail gripping means.

12. An apparatus for holding a wound bobbin core and a tail end of a thread wound on said bobbin core, comprising:

(A) a pallet having an upper surface;

(B) a vertical bobbin post rigidly secured to said upper surface of said pallet, said vertical bobbin post including a bobbin core holder at one end of said vertical bobbin post, said bobbin core holder being sized to create an interference force fit between said bobbin core holder and an interior surface of said bobbin core when said interior surface of said bobbin core is brought into contact with said bobbin core holder;

(C) a vertically depressable spring positioned within said vertical bobbin post, said vertical depressable spring having one end secured to said bobbin core holder; and (D) tail gripping means, rigidly secured to said upper surface of said pallet, for grasping said tail end of said thread wound on said bobbin core when said bobbin core is secured on said vertical bobbin post.

13. An apparatus for holding a wound bobbin core and a tail end of a thread wound on said bobbin core, comprising:

(A) a pallet having an upper surface;

(B) a vertical bobbin post rigidly secured to said upper surface of said pallet, said vertical bobbin post including means for detachably securing said bobbin core to said vertical bobbin post; and (C) tail gripping means, rigidly secured to said upper surface of said pallet, for grasping said tail end of said thread wound on said bobbin core when said bobbin core is secured on said vertical bobbin post, said tail gripping means including a vertical tail gripping post, a tail gripping wire, and a tail gripping spring, coupled to said vertical tail gripping post and said tail gripping wire, for grasping said tail end of said thread wound on said bobbin core and pinching said tail end between said vertical tail gripping post and said tail gripping wire.

14. A method for storing and retrieving a wound bobbin core and a tail end of a thread wound on said bobbin core, comprising the steps of:

(A) detachably mounting said wound bobbin core on a vertical bobbin post by applying a first downward vertical force to said bobbin core until an interior surface of said bobbin core is brought into contact with a bobbin core holder at one end of said vertical bobbin post and creating an interference force fit between said bobbin core holder and said interior surface of said bobbin core, said vertical bobbin post being rigidly secured to an upper surface of a pallet;

(B) detachably mounting said tail end of said thread wound on said bobbin on a tail gripping means, said tail gripping means being rigidly secured to said upper surface of said pallet; and (C) removing said wound bobbin core from said vertical bobbin post and said tail end from said tail gripping means;

wherein a vertically depressable spring positioned within said vertical bobbin post has one end secured to said bobbin core holder, said first downward force applied in step (A) being less than a second downward force required to depress said vertically depressable spring.

* * * * *